US006540111B2

(12) United States Patent
Sunnarborg

(10) Patent No.: US 6,540,111 B2
(45) Date of Patent: Apr. 1, 2003

(54) BOTTLED SODA DISPENSER

(76) Inventor: Duane J. Sunnarborg, P.O. Box 481, 10922 Boggess Ave., Fort Ogden, FL (US) 34267

( * ) Notice: Subject to any disclaimer, the term of this patent is extended or adjusted under 35 U.S.C. 154(b) by 0 days.

(21) Appl. No.: 09/961,832

(22) Filed: Sep. 25, 2001

(65) Prior Publication Data

US 2002/0070234 A1 Jun. 13, 2002

Related U.S. Application Data

(60) Provisional application No. 60/254,409, filed on Dec. 8, 2000.

(51) Int. Cl.[7] ..... B67D 5/56

(52) U.S. Cl. ..... 222/129; 222/183; 222/185.1; 222/325; 150/2.2

(58) Field of Search ..... 222/183, 185.1, 222/325, 481, 484, 518, 129; 150/2.2

(56) References Cited

U.S. PATENT DOCUMENTS

| | | | | | |
|---|---|---|---|---|---|
| 4,197,890 | A | * | 4/1980 | Simko | 215/12.1 |
| 4,911,334 | A | * | 3/1990 | Kedzierski | 222/131 |
| 5,118,009 | A | * | 6/1992 | Novitsky | 222/1 |
| 5,351,861 | A | * | 10/1994 | Jovellana | 222/144 |
| 5,947,339 | A | * | 9/1999 | Boshears et al. | 222/135 |
| 6,269,980 | B1 | * | 8/2001 | Randall et al. | 222/145.5 |

* cited by examiner

*Primary Examiner*—Gene Mancene
*Assistant Examiner*—Melvin A. Cartagena
(74) *Attorney, Agent, or Firm*—Frank A. Lukasik

(57) ABSTRACT

A bottled soda dispenser for dispensing soda from a 2-liter bottle without having to remove the cap each time. The invention allows for one hand dispensing and keeps the carbonation in the bottle. The dispenser consists of the base, a bottle holder, a valve system and actuating levers. An air inlet having a check valve provides sufficient air in the bottle as the soda is withdrawn.

2 Claims, 6 Drawing Sheets

BOTTLED SODA DISPENSER

This application claims the benefit of Provisional application Ser. No. 60/254,409 filed Dec. 8, 2000.

BACKGROUND OF THE INVENTION

1. Field of Invention

The field of the invention relates to soda dispensers and more particularly to a countertop mount and soda dispenser for standard 2 liter soda bottles.

2. Prior art

Typically, regular 2 liter soda bottles are fitted with a variety of sealing/dispenser tops to facilitate pouring and retention of effervescence within the beverage. These tops, while useful as seals and pourers, do not make the handling of the soda bottle easier. Typically, a 2 liter soda bottle is constructed of flexible plastic material which must be managed carefully to avoid spilling the beverage. The weight and size of the bottle make one-hand pouring almost impossible even for individuals with large strong hands. Children, with great difficulty and often with unexpected results, will attempt to pour from the bottle into a cup or other receptacle. Soda dispensers in fast food restaurants and other commercial locations, utilize a system of pressurized tanks of soda feeding a convenient dispenser head which is easily managed with one hand. The essence of these dispensers is a simple valve operated by a stirrup against which a drinking cup is pressed.

The present invention seeks to make standard 2 liter soda bottles as easy to use as the commercial dispensers by connecting the bottle to a mounting stand having a stirrup activated valve to dispense the beverage.

SUMMARY OF THE INVENTION

A mounting stand is provided having a stable support base and facility for one or more soda bottles to mounted over a simple dispensing valve.

A primary object of the invention is to permit the controlled dispensing of liquid beverages from a standard 2 liter bottle by one hand operation.

A further object of the invention is to provide storage for one or more beverage bottles.

A further object of the invention is to provide a portable soda dispenser for use at a variety of locations.

A further object of the invention is to insulate the beverage container so as to maintain the beverage at a suitable temperature for drinking.

A further object of the invention is to provide a simple means for attaching and detaching soda bottles in order to maintain a fresh supply of soda.

A further object of the invention is to provide a means whereby liquid can be dispensed from the bottle without the bottle collapsing as the liquid is poured.

A further object of the invention is to provide an adjustable means by which fresh soda bottles can be attached without having to be inverted (and spilling liquid thereby)

DESCRIPTION OF A PREFERRED EMBODIMENT OF THE INVENTION

Figure 1:
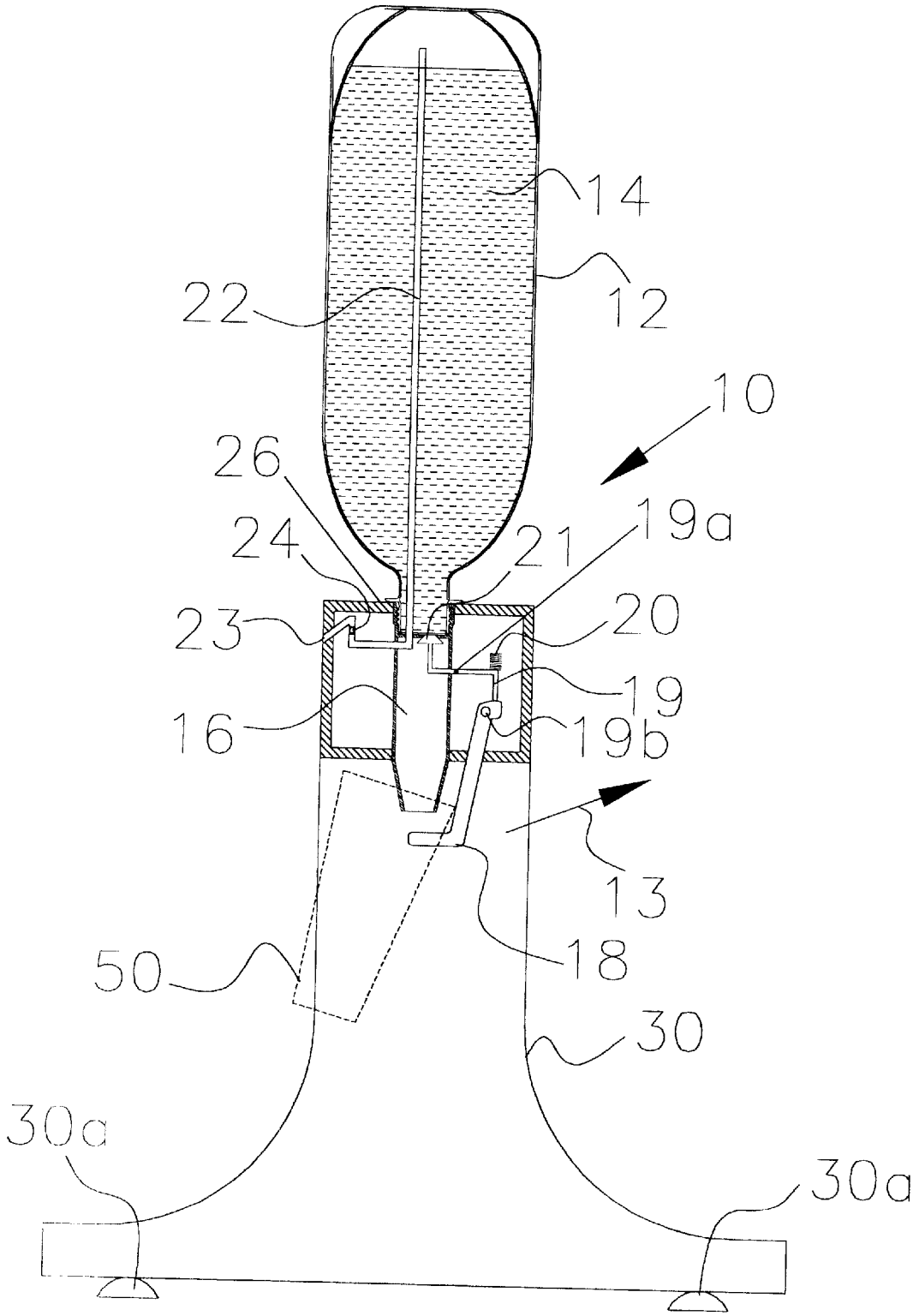
FIG. 1 is a diagrammatic end elevation, partially in section showing the invention.
Figure 2:
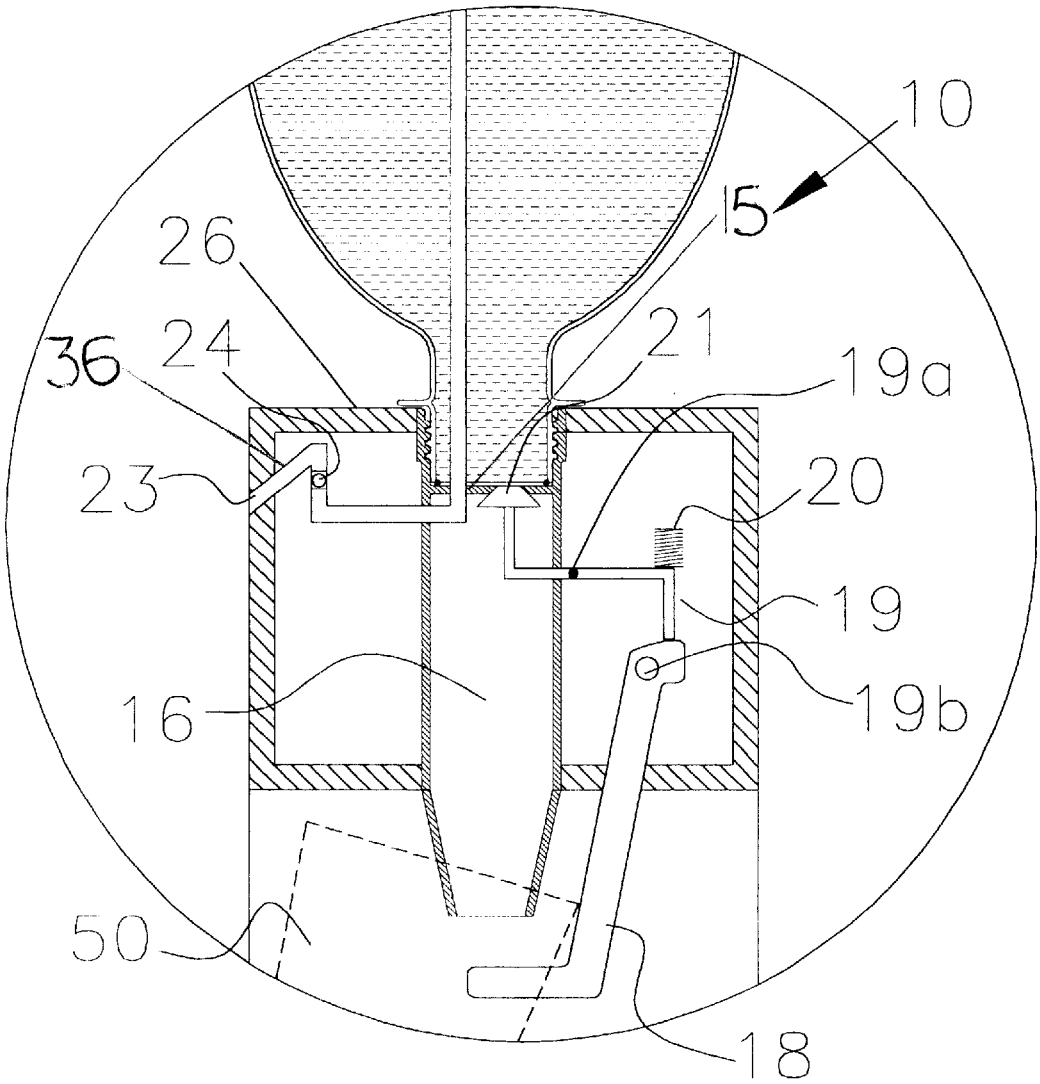
FIG. 2 is an enlargement of a section of the FIG. 1 showing closer detail of the valve mechanism.
Figure 3:
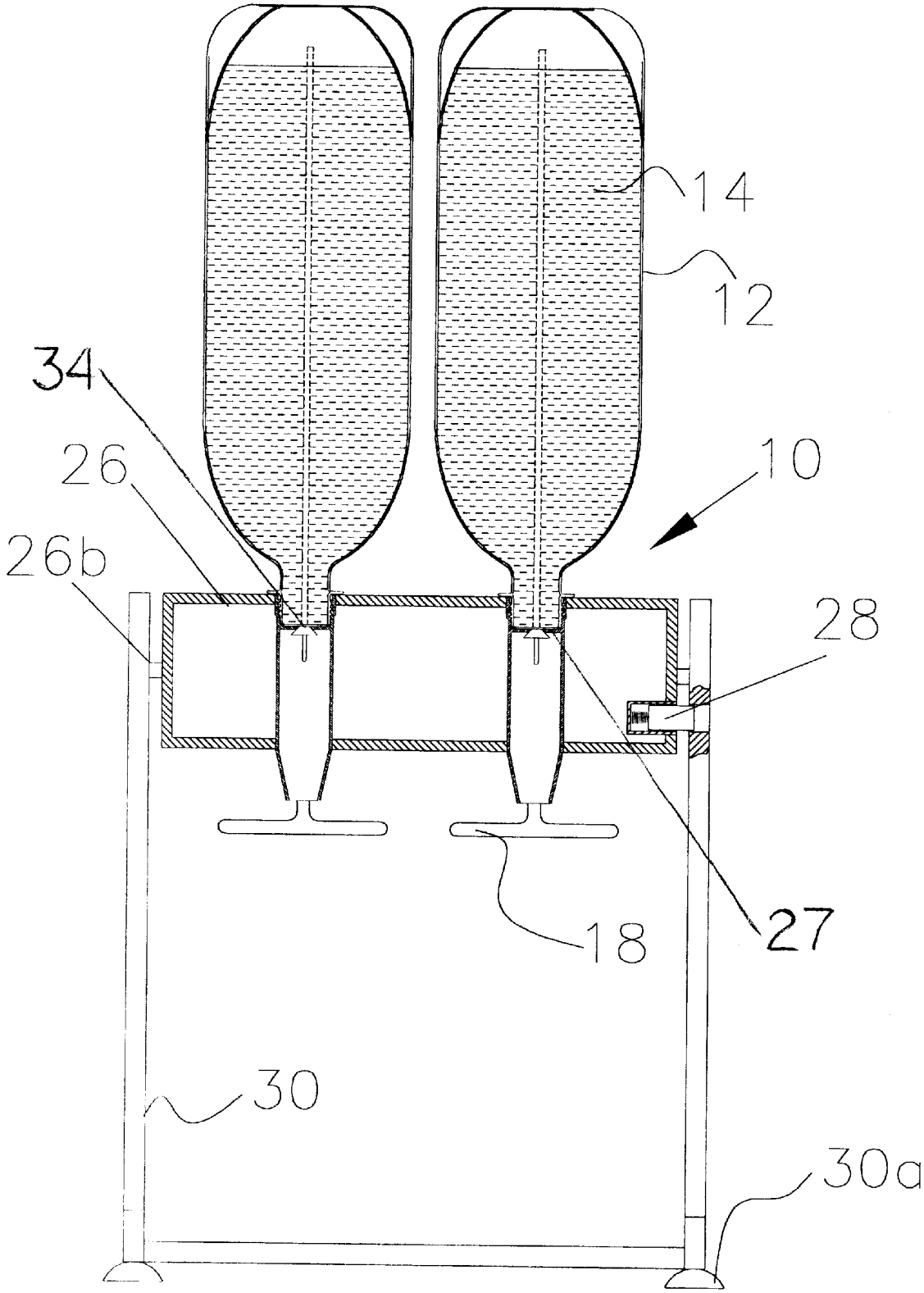
FIG. 3 is a front elevational view, partially in section showing the mounting of multiple soda bottles.
Figure 4:
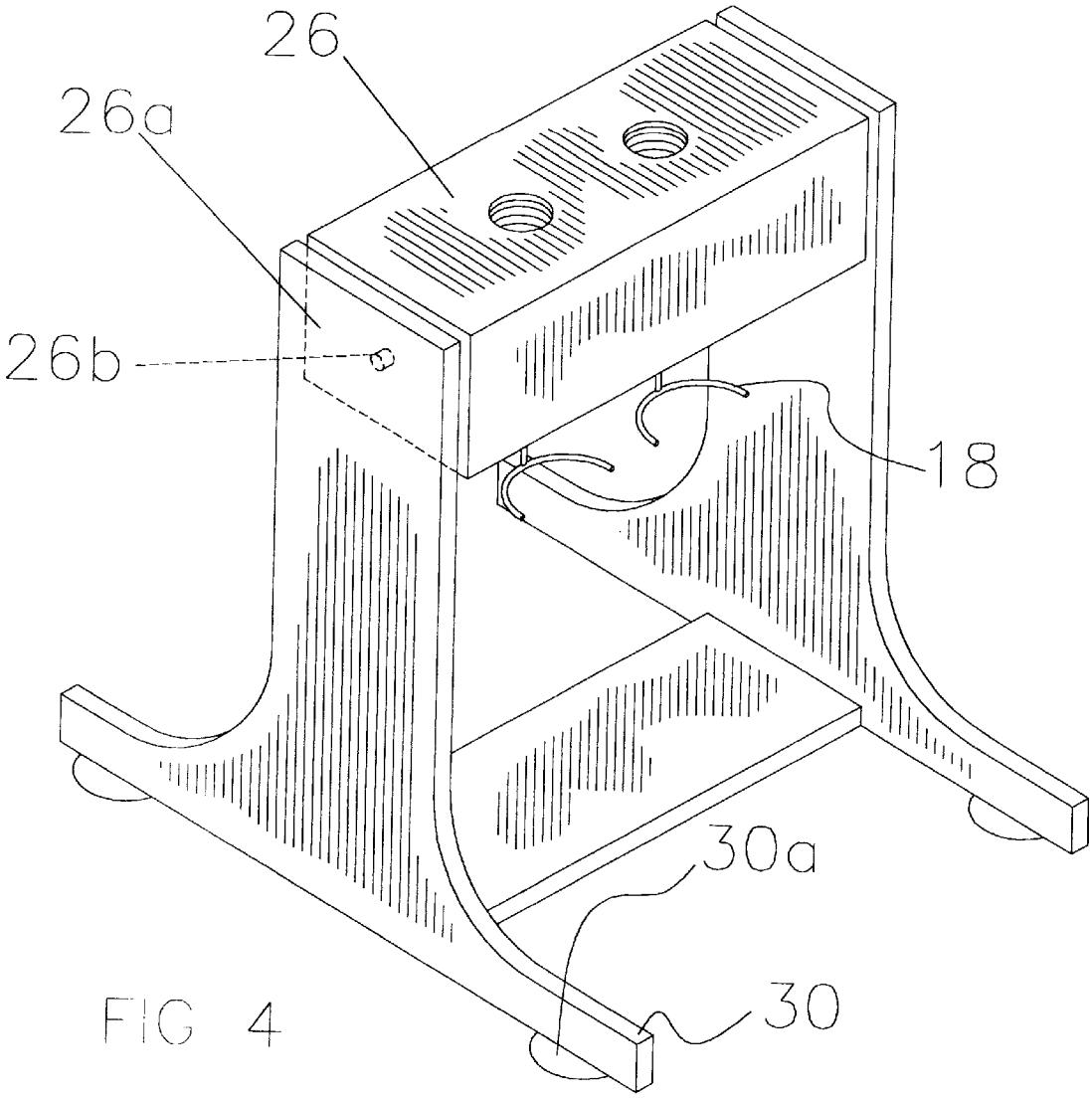
FIG. 4 is an isometric view of the invention
Figure 4A:
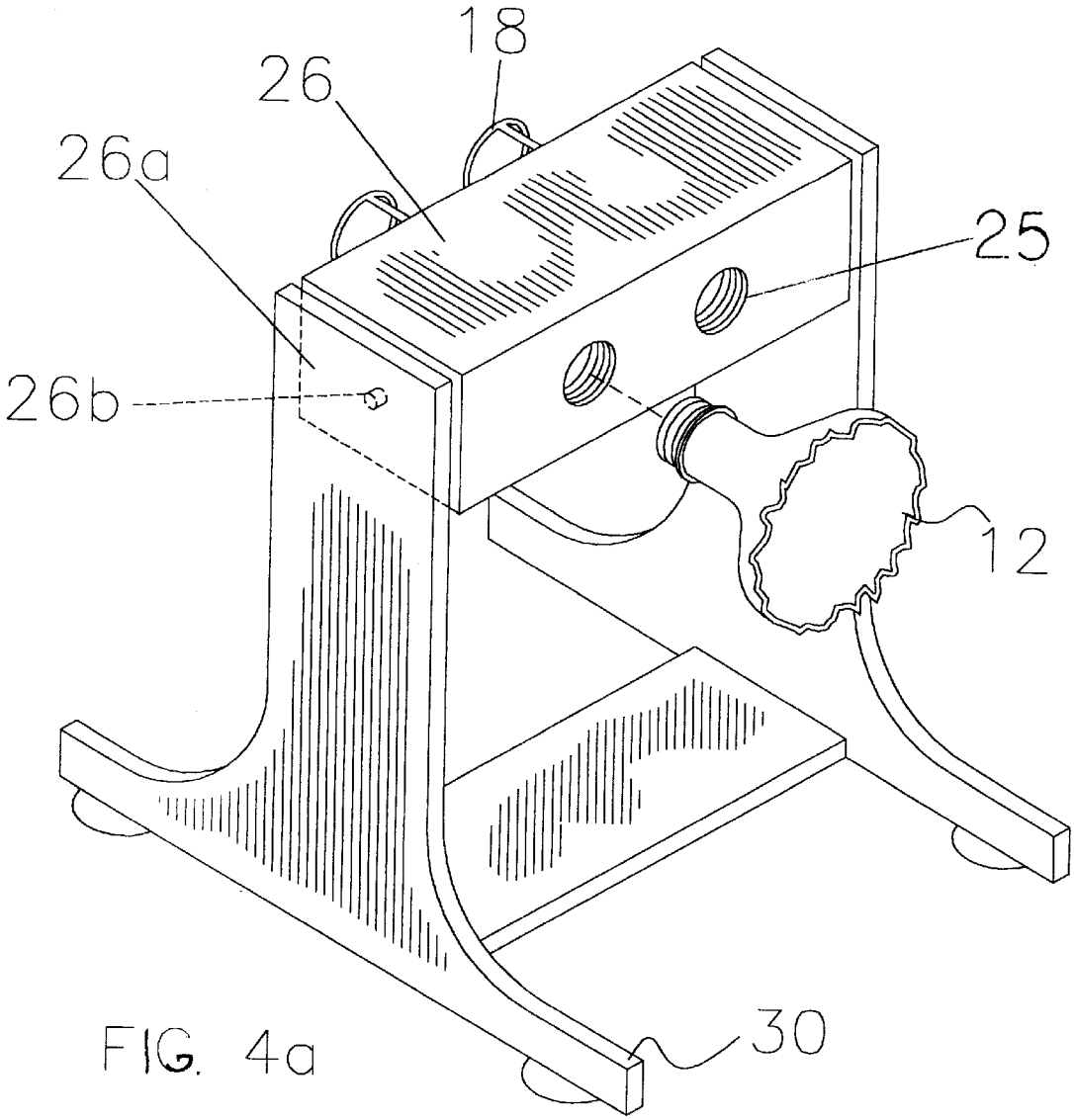
FIG. 4*a* is an isometric view of the invention as it appears when loading a soda bottle.

The bottled soda dispenser is illustrated generally by the numeral 10. The dispenser 10 consists generally of the 30, a bottle holder 26, a stopper valve 21, and actuating levers 19. The bottle holder 26 is pivoted on pivot 26*b* and is held in dispensing position by push button release 28 for loading. A first end of air tubes 22 extends upwardly through a first hole 15 formed in stopper 27 and through top inlet 25. A second end 36 extends horizontally to air inlet 23 which is sealed by check valve 24 to prevent carbonation from escaping from the bottle 12 at rest. As a soda is withdrawn, the vacuum created by the absence of the soda in the bottle 12, the check valve 24 opens to permit steady flow of the soda.

Stopper valve 21 consists of a second hole, outlet 34 and actuating lever 19. Actuating lever 19 is pivoted at 19*a* in the system. A second hole, fluid outlet 34, is formed in stopper 27. A stopper 21 is affixed at a first end of lever 19 and a bottle guide 18 is formed at a second end. The actuating lever 19 is held in a closed position by spring 20. pushing against the actuating lever 19 and holding valve 21 in position to seal fluid outlet 34.

To use the soda dispenser 10 of the invention, the bottle 12 cap is removed. The button 28 is pushed to release the bottle holder 26. The bottle holder 26 is then tilted forward and the two soda bottles 12 are screwed into threaded openings 25 formed in nozzles 16. The bottles 12 are brought to the upright position until the bottle holder 26 locks into place. To fill a glass, the glass is pushed against the glass guide 18, thereby opening the stopper 21 and dispensing the drink.

Figure 5:
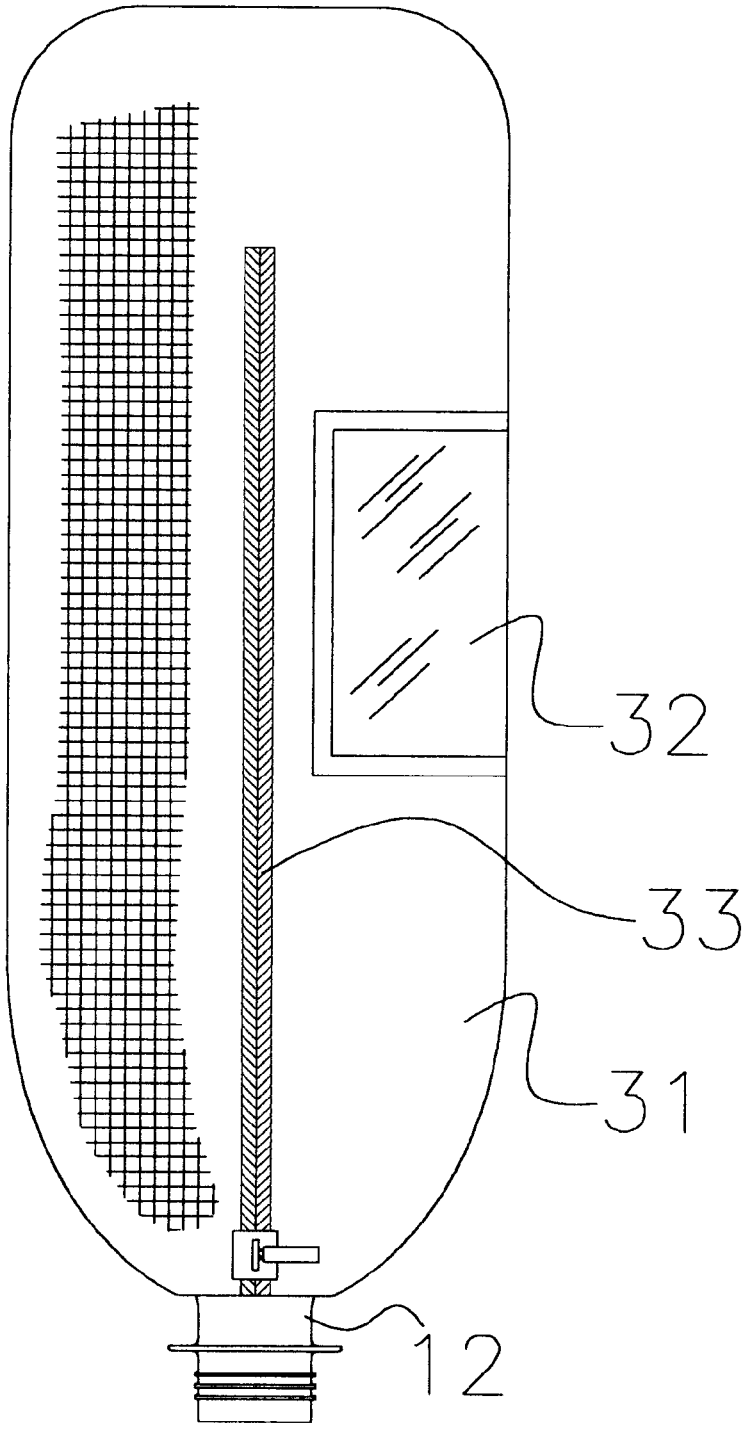
FIG. 5 is an elevational view of a typical soda bottle encased in an insulating jacket.

Refering now to FIG. 5, bottle 12 is covered by insulating jacket 31. Jacket 31 has a view window 32 and a zipper 33. Viewing window 32 permits the viewing of labels on bottles 12.

What is claimed is:

1. A bottled soda dispenser consisting of:

a stand having a first side and a second side, said first and second sides each having a lower section and an upper section, said upper section having swivel holes formed therein and opposing each other, said second side having a latch hole formed therein, a rotatable bottle holder having a first end and a second end, a top side and a bottom side, each of said ends having a swivel mounted thereon, said second end having a spring catch mounted therein, a first nozzle and a second nozzle mounted in said bottle holder through said top side and through said bottom side, each of said nozzles having a top end and a bottom end, said top end having a threaded portion formed therein and a stopper, said stopper having a first hole and a second hole formed therethrough, an air tube being mounted in said bottle holder, said air tube having a first end inserted through said first hole in each stopper and a second end having a horizontal portion having a vacuum operated check valve mounted therein and said air tube having an outlet through said bottle holder, a lever pivotally mounted in said bottle holder, said lever having a lower end, a middle portion, and a top end, a stopper valve mounted on said top end of said lever and a glass guide mounted on said lower end of said lever, said stopper valve being positioned to mate with said second hole formed in said stopper valve, a spring mounted in said bottle holder at one end and positioned above and contacting said lever middle portion, whereby said spring retains said stopper in a closed position in said second hole.

2. A bottled soda dispenser of claim 1 wherein said bottles are covered by an insulating jacket, said jacket having a view window and a zipper.

* * * * *